US007651405B2

(12) United States Patent
Lynch

(10) Patent No.: US 7,651,405 B2
(45) Date of Patent: Jan. 26, 2010

(54) DEVICE FOR VISUALIZING AND PRACTICING A CORRECT GOLF SWING

(76) Inventor: Travis Lynch, 12610 Brunswick La., Bowie, MD (US) 20715

( * ) Notice: Subject to any disclaimer, the term of this patent is extended or adjusted under 35 U.S.C. 154(b) by 0 days.

(21) Appl. No.: 12/290,727

(22) Filed: Nov. 3, 2008

(65) Prior Publication Data

US 2009/0118029 A1 May 7, 2009

Related U.S. Application Data

(60) Provisional application No. 61/001,646, filed on Nov. 2, 2007.

(51) Int. Cl.
*A63B 69/36* (2006.01)

(52) U.S. Cl. ..... 473/257; 473/267

(58) Field of Classification Search ..... 473/257–278, 473/409

See application file for complete search history.

(56) References Cited

U.S. PATENT DOCUMENTS 3,097,437 A * 7/1963 Harrison ..... 473/267
3,110,495 A * 11/1963 Carter ..... 473/267
3,353,282 A * 11/1967 Sneed ..... 434/257
3,917,278 A * 11/1975 Steinman, Jr. ..... 473/267
4,383,687 A * 5/1983 Wolff ..... 473/267
5,131,659 A * 7/1992 Lindberg, Jr. ..... 473/267
5,294,124 A * 3/1994 Florian ..... 473/267
5,348,304 A * 9/1994 Meade ..... 473/409
5,842,931 A * 12/1998 Payne ..... 473/208
2003/0148815 A1* 8/2003 Swistock ..... 473/257
2007/0243944 A1* 10/2007 Paukune et al. ..... 473/267

* cited by examiner

*Primary Examiner*—Nini Legesse
(74) *Attorney, Agent, or Firm*—Whiteford, Taylor & Preston LLP; Jeffrey C. Maynard

(57) ABSTRACT

A golf training device comprises two shatter-resistant mirrors. A striking mirror is held in a horizontal position in the hitting area and is used as a striking mat for hitting golf balls. A second, adjustable mirror is positioned above the striking mirror. The adjustable mirror can be moved relative to the striking mirror and has means for adjusting the tilt angle of the adjustable mirror. Together, the two mirrors can be used to create the effect of a single virtual mirror lying beneath the ground surface so that the golfer can see his swing plane from along the edge of the plane of his swing as he hits the ball.

20 Claims, 4 Drawing Sheets

DEVICE FOR VISUALIZING AND PRACTICING A CORRECT GOLF SWING

CROSS REFERENCE TO RELATED APPLICATION

This application is based upon and claims benefit of co-owned U.S. Provisional Patent Application Ser. No. 61/001,646 entitled "Device for Visualizing and Practicing a Correct Golf Swing", filed with the U.S. Patent and Trademark Office on Nov. 2, 2007 by the inventor herein, the specification of which is incorporated herein by reference.

BACKGROUND OF THE INVENTION

1. Field of the Invention

The present invention relates generally to a golf swing monitoring device and particularly to a device that permits a golfer to see his swing from along the edge of the plane of the swing.

2. Background of the Prior Art

Golf is a game in which form is emphasized over athletic ability. It is generally thought for a golf club to move a golf ball along a desired or intended line to a target, the head of the golf club first must strike the golf ball while traveling in a curved path at a point tangential to the desired line, and second the plane of the golf club must be normal to the vertical plane of intended flight. Proper alignment throughout the swing is essential to obtain any degree of success in playing golf. The second requirement is generally met by maintaining a proper grip on the golf club throughout the swing. The first requirement is best achieved by maintaining the golf club in a proper plane through the swing.

Failure to maintain the golf club in the proper plane through the swing has generally resulted from either starting the golf club in motion in an improper plane, or from movement, either lateral or vertical, of the center of rotation of the golfer's swing due to the effort of the backswing.

Repetitive practice is very effective in developing a correct golf swing. However, to practice with the wrong form serves only to foster bad habits. Nevertheless, it is extremely difficult for a golfer to correct or improve his own "swing" because he needs another person, preferably a professional instructor, to watch him while he is hitting the ball.

The need to eliminate bad habits has prompted the popular use of video cameras to record player's swings. Practice techniques using video cameras have very limited effectiveness, however, because the golfer cannot observe himself while he or she is being recorded and must wait until later to analyze and adjust his or her stroke. There is a need for a device that provides real time visual feedback on the condition of the golfer's swing from address to follow-through so that immediate corrective action can be taken by the golfer.

Many different forms of golf training aids have been proposed previously. British Pat. No. 1,258,018 of Devac Inc. describes a golf club practice swing guide comprising a mechanical assembly of pivoted arms mounted on an upright post, one end of one arm being adapted to be clamped to the shaft of a golf club. For the purpose of assisting the golfer to note and correct errors in stance and swing, a square mirror is adjustably mounted on the upright post so that the golfer can view his actions and see how he is swinging the golf club as well as feeling from the mechanical assembly whether he is swinging improperly. However, when the guide is in use, the upright post holding the mirror is located opposite the golfer on the far side of a mat on which a golf ball to be hit is placed. Therefore, in order to look in the mirror, the golfer must raise his eyes from the ball to the mirror beyond it. Thus, apart from the artificiality of swinging a club attached to an elaborate mechanism, the swing guide of British Pat. No. 1,258,018 would also tend to distract the golfer from keeping his head down and his eyes on the ball.

Other prior art patents, such as U.S. Pat. Nos. 3,000,261; 3,097,437; 3,110,495; 3,917,278; 4,181,307; 4,383,687; 5,116,058; 5,297,796; 5,348,304; 5,458,340; 5,842,931; 6,592,376; 7,048,638; and 7,048,641 have permitted a golfer to observe the swing of the golf club. So far as is known, no apparatus has been provided in the prior art to permit a golfer to directly observe golf club motion from the edge of the plane of the golf swing during the swing of a golf club.

SUMMARY OF THE INVENTION

A principal concept of the present invention is to provide instant feedback to a golfer while hitting golf balls in order to help visually analyze the golf swing.

It is, therefore, an object of the present invention to provide a golf swing training device that avoids the disadvantages of the prior art.

Another object of the present invention is to provide a golf swing training device that allows the golfer to practice his or her golf swing. A related object of the present invention is to provide a golf swing training device that allows the user to observe his or her stroke throughout the swing. A further related object of the present invention is to provide a golf swing training device that allows a user to use all of his or her own golf clubs for practice.

Another object of the present invention is to provide a golf swing training device that is adjustable for any user and may be used to observe various portions of the user's body during the swing. A related object of the present invention is to provide a golf swing training device with reflecting mirrors by which the user may watch his or her deviation from proper form.

Another object of the present invention is to provide a golf swing training device that is relatively simple in construction. A related object of the present invention is to provide a golf swing training device that is relatively simple to use and to adjust for optimal effectiveness.

This invention enables a new apparatus for training a golfer in proper movement of swinging a golf club by permitting the golfer to observe motion of the golf club, and body movement of the golfer during the golf swing, from the edge of the swing plane. A pair of mirrors reflects the golfer's image to the golfer during the swing while also permitting the golfer to observe club motion during the swing. One of the mirrors is supported by a support means in a position where the golfer may observe movement of the golf club and the golfer's body during the swing. With the apparatus of the present invention, a golfer thus is permitted to observe and control both motion of the golf club and movement of the golfer's body, while making a golf swing.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference symbols are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Existing mirror-based solutions for observing a golf swing either fail to show the swing plane "edge-on", showing a skewed and misleading view instead, or require the user to look away from the ball while swinging the golf club. Most devices are not adjustable to accommodate every club in the golfer's bag. Many devices do not permit the golfer to hit balls using their own clubs or at full power. Additionally, many devices are bulky and non-portable.

Figure 1:
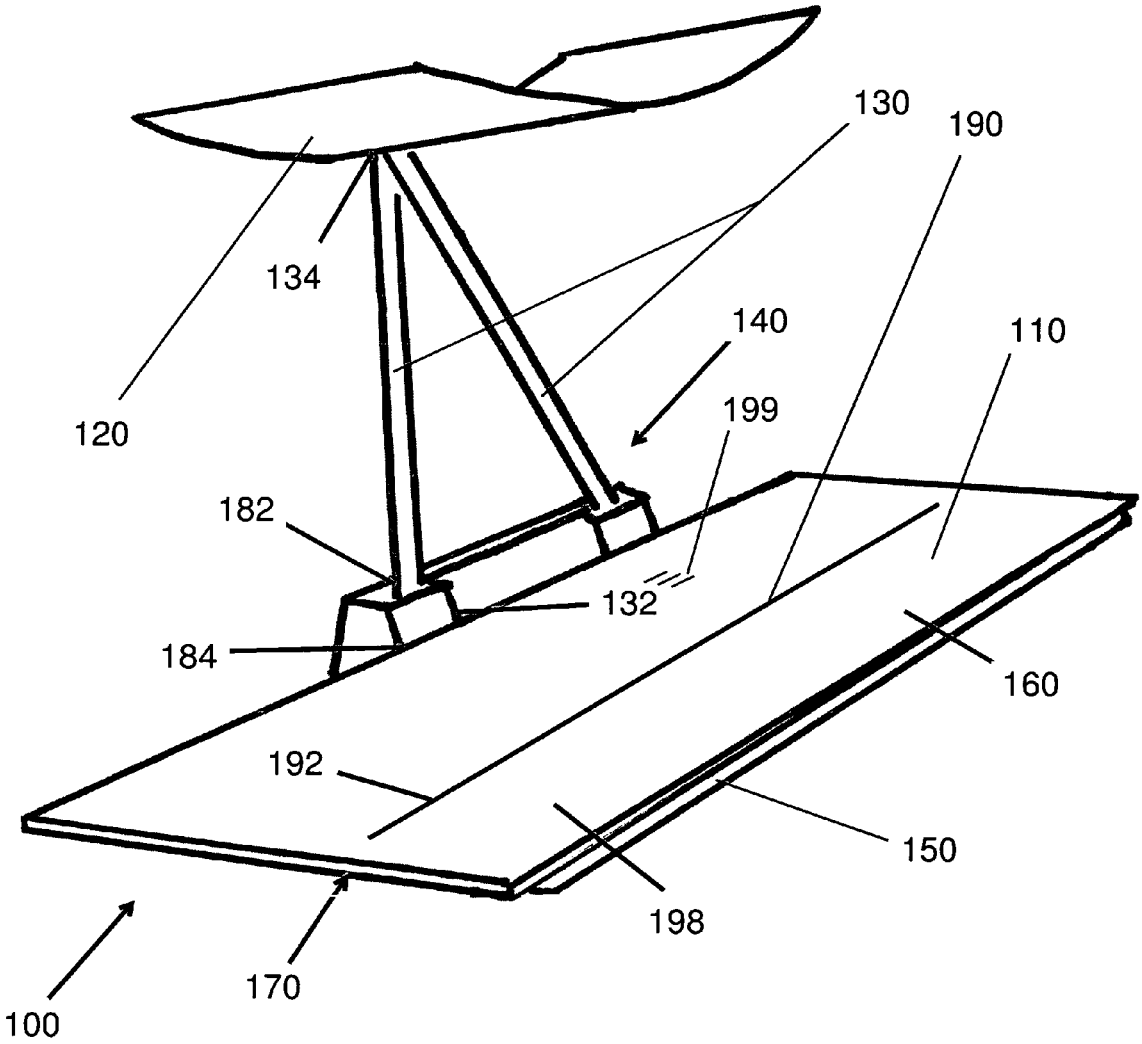
FIG. 1 is a perspective view of a golf swing training device according to the present invention.

Referring to the drawings, FIG. 1 shows a perspective view of a golf swing training device 100 according to the present invention. In the current embodiment, the device includes a striking mirror 110, also referred to herein as a virtualization strike plate, operationally connected to an adjustable mirror 120, also referred to herein as a virtualization mirror. A frame assembly 130 connects the striking mirror 110 to the adjustable mirror 120. An adjustment mechanism 140 allows the adjustment of the angular orientation of the adjustable mirror 120 to the striking mirror 110, as show in FIG. 2.

In a preferred embodiment, a shatter-resistant mirror is used for both the striking mirror 110 and the adjustable mirror 120. The striking mirror 110 is intended to be used in a substantially horizontal position, generally lying in a plane that is substantially perpendicular to a vertical position of a user of the device 100, and may be so positioned by placement upon the ground or an alternative surface. It is contemplated that the horizontal positioning of the striking mirror 110 may be altered as desired by a user of the device 100.

The virtualization strike plate includes a top surface 160 and a bottom surface 170 and may be formed of various materials. In a preferred embodiment, the virtualization strike plate is substantially integral, wherein the top and bottom surfaces 160, 170 are generally uniform in material and dimension. It is contemplated that the top and bottom surfaces 160, 170 may not be integrally formed. Additionally, the materials used to form the top and bottom surfaces 160, 170 may be varied relative to one another. The edges of the virtualization strike plate include dimensions that provide a separation space between the top and bottom surfaces 160, 170. It is understood that the dimensions of the edges, and therefore the dimensions of the separation space, may be varied without departing from the scope and spirit of the present invention. It is also contemplated that the virtualization strike plate formed of non-integral top surface 160 and bottom surface 170 may include an overall edge dimension(s) that is determined by the individual edge dimension(s) of the top and bottom surfaces 160, 170.

Figure 3:
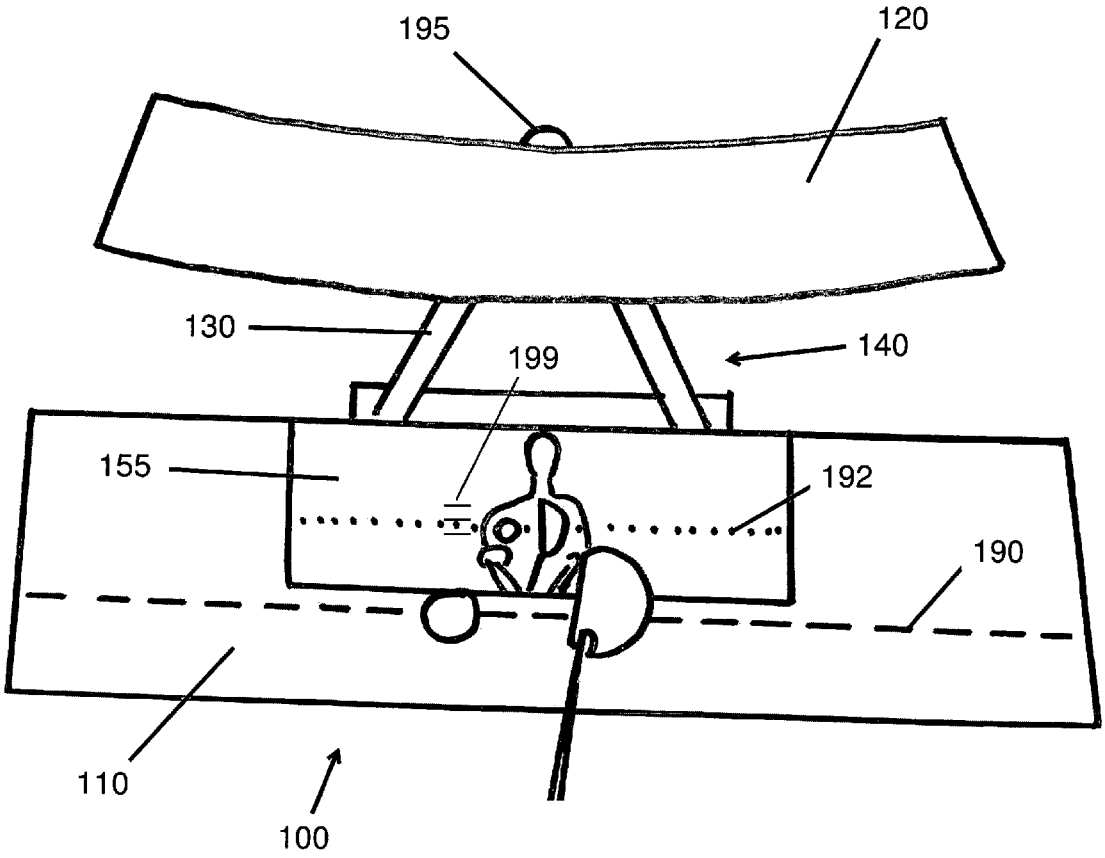
FIG. 3 is a view from the golfer's perspective, showing the reflected image of a golfer using the golf swing training device according to the present invention.

In a preferred embodiment, the top surface 160 provides a reflective strike surface. This reflective surface in operation with the adjustable mirror 120 allows the device to form a virtual image 155 that may be viewed by the user when using the device, as shown in FIG. 3. The virtual image 155 formed is a virtual edge-on perspective of the swing plane, as the swing plane intersects the device of the current invention. In the current embodiment, the reflective strike surface encompasses the entire top surface 160. However, it is contemplated that the reflective strike surface may encompass less than the entire top surface 160.

The bottom surface 170, as stated above, may be integrally or separately formed of the same material as the top surface 160 or, in the alternative, the two surfaces may be formed of various materials different from one another. The different materials that may be employed to form the top and bottom surfaces 160, 170 are limited only by the requirement that the striking mirror 110 be shatter-resistant. Bottom surface 170 may be placed in direct contact with the ground or an alternative surface for use of the current invention. In a preferred embodiment, as show in FIG. 1, bottom surface 170 is connected with a support mechanism 150 that is in direct contact with the ground or alternative surface. The support mechanism 150 may place the striking mirror 110, the top surface 160, and/or the bottom surface 170 a certain distance from the ground or alternative surface upon which the device 100 is placed. In a preferred embodiment, the striking mirror 110 may be suspended approximately an inch above ground level so that it can deflect downward when hit. Thus, the striking mirror 110 has a first position, generally a horizontal planar position relative to the underlying surface, when not being struck and achieves a second position upon deflection resulting from being struck. Importantly, the support mechanism 150 provides for the return of the striking mirror 110 to the first position after the force that resulted in the deflection to the second position has been removed. It is to be understood that the amount of deflection or range of movement between the first and second positions of the striking mirror 110 may vary depending upon the support mechanism 150.

Support mechanism 150 may allow for such deflection capabilities in various ways, such as by employing a spring or foam pad under the striking mirror 110. Alternatively, support mechanism 150 may include one or more spring-loaded support columns connected to the bottom surface 170 and in contact with the underlying surface of the device. Therefore, it is to be understood that the mechanisms employed and materials used to allow for the deflection of striking mirror 110 and/or to provide for the vertical positioning of striking mirror 110 relative to the ground or alternative surface upon which the device is placed may vary as contemplated by those of ordinary skill in the art.

A user interacts directly with the top surface 160 of the striking mirror 110 while swinging a golf club. In operation, the substantially planar surface of striking mirror 110 provides a user who is swinging a golf club in a swing plane a hitting area or strike area that intersects the swing plane of a golf club at some point within the swing plane. In a preferred embodiment, the hitting area or strike area is a point within the arc of the user's swing plane where the club head most closely approaches and/or strikes the top surface 160 of the striking mirror 110. Those skilled in the art will understand that the top surface 160 of the striking mirror 110, in this embodiment, is used in a similar manner as a striking mat for hitting golf balls.

The current invention contemplates its use with or without golf balls. Where golf balls are being used, they may be placed upon the top surface 160. The placement of the golf balls may occur directly upon the top surface 160 or in proximity to the top surface 160. The relative placement of a golf ball upon or in proximity to the top surface 160 of the current invention is limited only by the requirement that it be so positioned that the virtual image of the edge-on perspective of the swing plane relative to the ball, where such swing plane intersects with the device, may be observed within the line of sight of a user of the device 100. Thus, the line of sight for a user of the device is that visual orientation whereby the user, at their discretion, is able to visually ascertain and maintain their desired orientation of visual discernment of a golf ball throughout the execution of a swing of a golf club in their desired swing plane with the intent to strike the golf ball with the head of the club.

It is further contemplated that the proximity of the golf ball to the top surface 160 may be determined by the use of a mounting assembly. In a preferred embodiment, the mounting assembly comprises a simulated golf tee, which may elevate the position of the golf ball to varying heights relative to the top surface 160. The elevated position of the golf ball may be completely user directed or may be limited in some manner through a pre-determined positioning mechanism. The positioning mechanism may include simulated golf tees of pre-determined lengths and/or pre-determined positions upon top surface 160. It is contemplated that the simulated golf tees may use mild adhesive or suction cups to allow for the positioning and adjustment of position of the simulated golf tees upon top surface 160. Golf tees of various lengths may be simulated with short rubber tubes that are soft enough to absorb impact yet stiff enough to support the weight of a golf ball. To prevent these simulated tees from being knocked away from the device when struck, they may be anchored to the device via a tether of braided nylon cord or other material. Alternatively, the tee may be anchored directly to the striking mirror 110. In a preferred embodiment, the anchor consists of a round rubberized ball and a teardrop shaped hole cut into the striking mirror 110 to hold the anchor during use and permit easy removal for storage.

The adjustable mirror 120 is generally positioned above, in varying distances of vertical proximity, to the striking mirror 110. The adjustable mirror 120 may be curved along its long axis to compress the reflected image 155 on the striking mirror 110. This allows the reflected image 155 provided on the striking mirror 110 to be smaller (see FIG. 3) and enables the golfer to see the golf club in all positions while not requiring significant head or eye movement away from the golf ball. This compression also increases the sensitivity of the device because any angle of deviation from the swing plane will appear to be larger. Alternatively, the adjustable mirror 120 may be spherically curved so that the compressed image has more normal proportions.

Frame assembly 130 connects adjustable mirror 120 to striking mirror 110. A first connection point 132 of frame assembly 130 connects with the striking mirror 110 and a second connection point 134 connects with the adjustable mirror 120. The connection points may be static connections and/or dynamic connections. Any manner or method for suspending a mirror, video screen, or optically clear striking surface so that it may be used to provide visual feedback and be used to strike golf balls with a golf club without breaking may be employed by the current invention without departing from its scope and spirit. Thus, the assembly(s) and/or mechanism(s) employed to allow the connection points to make their connection with either the striking mirror 110 or adjustable mirror 120 may vary as contemplated by those skilled in the art. In alternative embodiments, the frame assembly 130 may be capable of allowing for the alteration of the vertical and horizontal position of adjustable mirror 120 relative to the striking mirror 110.

Figure 2:
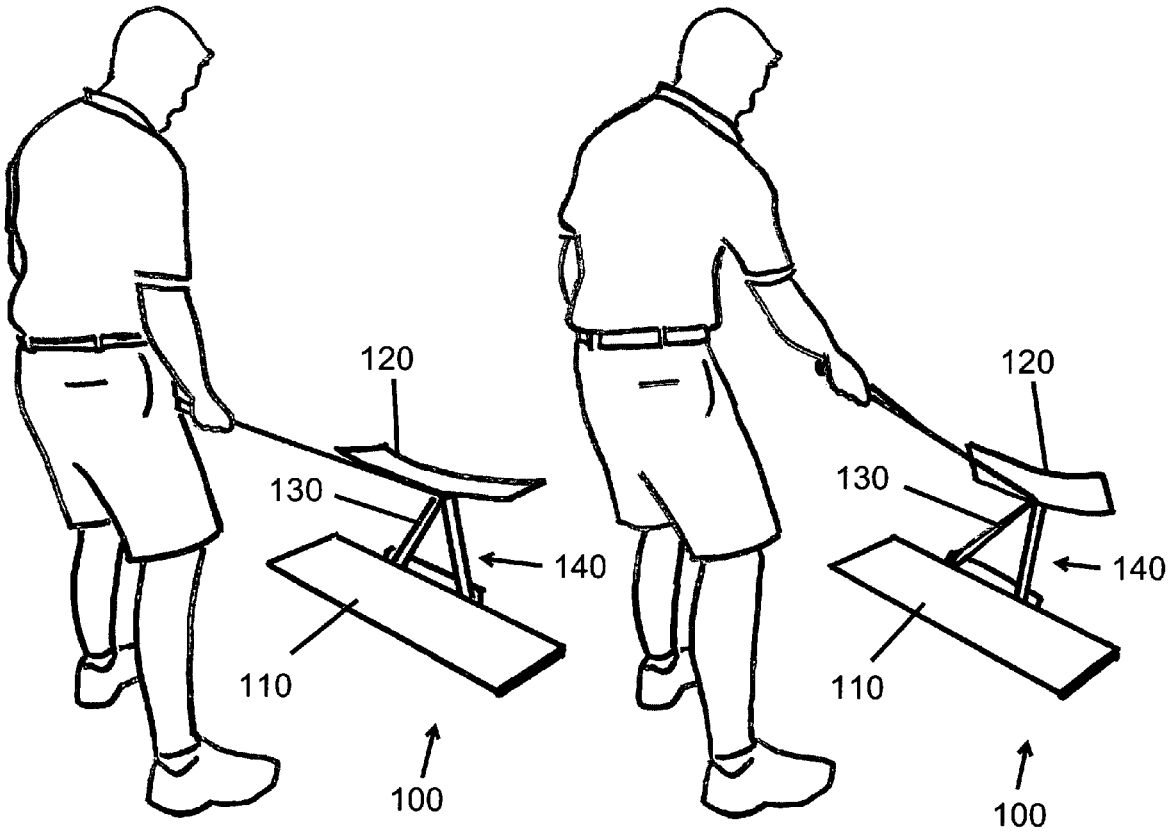
FIG. 2 illustrates a method of adjusting the golf swing training device according to the present invention.

In a preferred embodiment, the device 100 further includes an adjustment mechanism 140 wherein the adjustable mirror 120 is capable of vertical and/or lateral movement. Furthermore, in a preferred embodiment, the adjustable mirror 120 is capable of having its angular orientation relative to the striking mirror 110 manipulated, see FIG. 2. Various technologies, devices, means, and the like as would be contemplated for use by those skilled in the art may be employed for the adjustment mechanism 140. The adjustment mechanism 140 may be integral to the frame assembly 130 or may be capable of attaching to the frame assembly 130. FIGS. 1 and 2 indicate that the adjustment mechanism 140 connects, through a first connection point 182, with the first connection point 132 of frame assembly 130. The adjustment mechanism 140 also includes a second connection point 184 that allows it to connect with striking mirror 110. It is further contemplated that the adjustment mechanism 140 may include the capability of adjusting the vertical position of the adjustable mirror 120 relative to the position of the striking mirror 110. In a further alternative embodiment, adjustment mechanism 140 may include a positioning mechanism whereby the position of the adjustable mirror 120 may be changed relative to the lengthwise axis of the striking mirror 110.

The striking mirror 110 may further include an alignment mechanism 190. In a preferred embodiment, the alignment mechanism 190 includes a target line 192 that may be drawn or etched onto the striking mirror 110. The target line 192 may be used as reference point in tracking the arc of a swing plane, for making various adjustments and for positioning golf balls on the device. For example, one or more alignment guides may help the golfer to place a tee according to the height of the tee so that a golf ball placed on it will be in the swing plane. In alternative embodiments, it is contemplated that a rear surface mirroring technique may be used so that a pattern of alignment guides may be etched into the mirror layer and thus be visible from the front. This pattern may include lines to indicate target line, swing plane, ball placement, tee placement, and other alignment guides.

In operation, the striking mirror 110 and adjustable mirror 120 of the current invention cooperate to create the effect of a single virtual mirror lying beneath the ground surface, such as shown in FIG. 3. When properly adjusted and when a golfer stands to address a ball on the striking mirror 110, the golfer can see a reflected image 155 of the adjustable mirror 120, along the target line 192, which appears to be several inches below ground level. The combination of the two mirrors creates a "virtual" mirror beneath the ground level. When properly adjusted, this "virtual" mirror reflects the golfer's image providing a virtual image to the golfer and instant visual feedback of the golf club's orientation to the swing plane as indicated by a reflection of the target line 192. FIG. 3 shows a reflection that permits the golfer to see the proper swing plane "edge-on". Any use and/or configuration of mirror, lens, prism or camera in the swing plane providing the golfer with instant visual feedback showing the swing plane edge on by directing the image to be viewed on or through the striking surface is contemplated by the current invention.

Alignment marks 199 may be included on the striking mirror 110 in an area where the virtual image 155 is viewed. During the swing, the user may readily visualize his upper body motion relative to the swing plane and the golf ball by observing the juxtaposition (or apparent motion) of the reflection of the golf ball and swing plane line 192 against the alignment marks 199 that may be etched in the visualization area of the striking mirror 110. Apparent motion of the golf ball's reflection leftwards and rightwards from the alignment marks 199 on the striking mirror 110 correspond to leftward and rightward motion of the user's upper body. Apparent motion of the golf ball's reflection upwards and downwards along the alignment marks 199 on the striking mirror 110 corresponds to upper body motion that is either heel-to-toe or a change in elevation, both of which are generally considered undesirable in the golf swing.

Device 100 of the current invention is capable of being adjusted and thereby allows it to work with any golf club and any swing plane angle. For instance, whereas the full swing plane normally passes through the golfer's shoulders, the chipping swing plane passes through the golfer's abdomen. It is possible to manipulate the device while standing at address by simply using a golf club to position the adjustable mirror 120. FIG. 2 illustrates a method of adjusting the golf swing training device 100 according to the present invention. To adjust the device, the golfer first takes a stance so as to strike a ball lying on the target line 192. Then, the position and tilt angle of the adjustable mirror 120 are set so the golfer sees that the target line 192 reflected in the virtual mirror is superimposed over the golfer's body at the desired swing plane (normally the shoulders). In an alternative embodiment, the adjustment mechanism 140 may include a rubberized handle 195 that can be manipulated by hand or with a golf club, thus allowing the golfer to remain in the address position while adjusting the angle of the adjustable mirror 120. The current invention contemplates the use of any device capable of positioning a mirror, lens, prism, or camera at a relative angle to the target line 192 so that it directs the golfer's image in such a way that the golfer is able to view a real-time image of the swing plane, "edge on" while swinging a golf club, and within the user's line of sight (without having to turn his/her head to see the image 155). This includes images that are from any perspective in the swing plane.

In a preferred embodiment, an optically clear film 198 or impact film may be used to protect the top surface 160 of the striking mirror 110 from scuffmarks. In some embodiments, the clear film 198 may have alignment marks 199 and other information to facilitate instruction and practice. There may be many variations of the printed material on the overlay sheets; this is to facilitate many different instructional goals (e.g. driver, long irons, short irons, wedges, chipping, etc.). Scuffmarks left on the film 198 serve as a useful record of the location and direction of the golf club at impact with the surface of the striking mirror 110.

The film 198 should be tear-resistant and protect the top surface 160 from scuff marks and scratches. In a preferred embodiment, the film 198 will be held in place so that it does not become separated from the top surface 160 during use. The film 198 can be fixed to the striking mirror surface 160 with a mild adhesive, a fine layer of water, or other solution that promotes at least temporary adhesion between the film 198 and the top surface 160. Alternatively, the film 198 may be held in place with clips, pins, adhesive, tape, or by other means. Thus, the film 198 should be disposable and can be replaced as desired.

The device 100 is lightweight and folds flat so as to be portable. In a preferred embodiment, the frame assembly 130 is a collapsible frame assembly that allows the adjustable mirror 120 to be positioned relative to the striking mirror 110 in such a manner that the device 100 is substantially flat. It is contemplated that the collapsibility of the device 100 and frame assembly 130 may be provided by various technologies, mechanisms, and devices as are known by those skilled in the art. In a preferred embodiment, a carrying handle and/or strap permit the device be transported like a briefcase, slung over a shoulder, or hung on a wall.

In a preferred embodiment, the device 100 is capable of fitting into a molded case. The case may include a handle and/or strap for carrying, cavities for accessory items (such as an instructional DVD, spray bottle/squeegee, alcohol cleaning pads, simulated tees, and/or practice balls). Impact film sheets may be contained within and stored in various locations, such as the space beneath the striking mirror. Adjustable mirror 120 is capable of moving easily from a storage position (flat against the case and/or striking mirror 110) to its proper usage position. A spring hinge or detent hinge may be used for this purpose. In a preferred embodiment, curved steel ribbon tape (such as is commonly used in a steel tape measure) may be used as a detent hinge.

In operation, the case may serve as or as part of a support mechanism for the virtualization strike plate which allows for the deflection of the strike plate when being struck by a golf club. The case may include stiffening ribs to minimize the "play" in the adjustable mirror 120 when adjusting its position. Case ribs may be formed to facilitate positioning of the adjustable mirror 120 by pushing or pulling it with the head of a golf club while remaining in a normal golf stance over the device.

Frame assembly 130 may also provide a stand for various items, such as instructional materials. In some embodiments, the frame assembly 130 and adjustable mirror 120 may be constructed with breakaway joints that can pop loose from the frame assembly 130 without significant damage to the adjustable mirror 120 and frame assembly 130 and can be snapped back into place in order to protect the device 100 from accidental strikes by the golf club.

Figure 4:
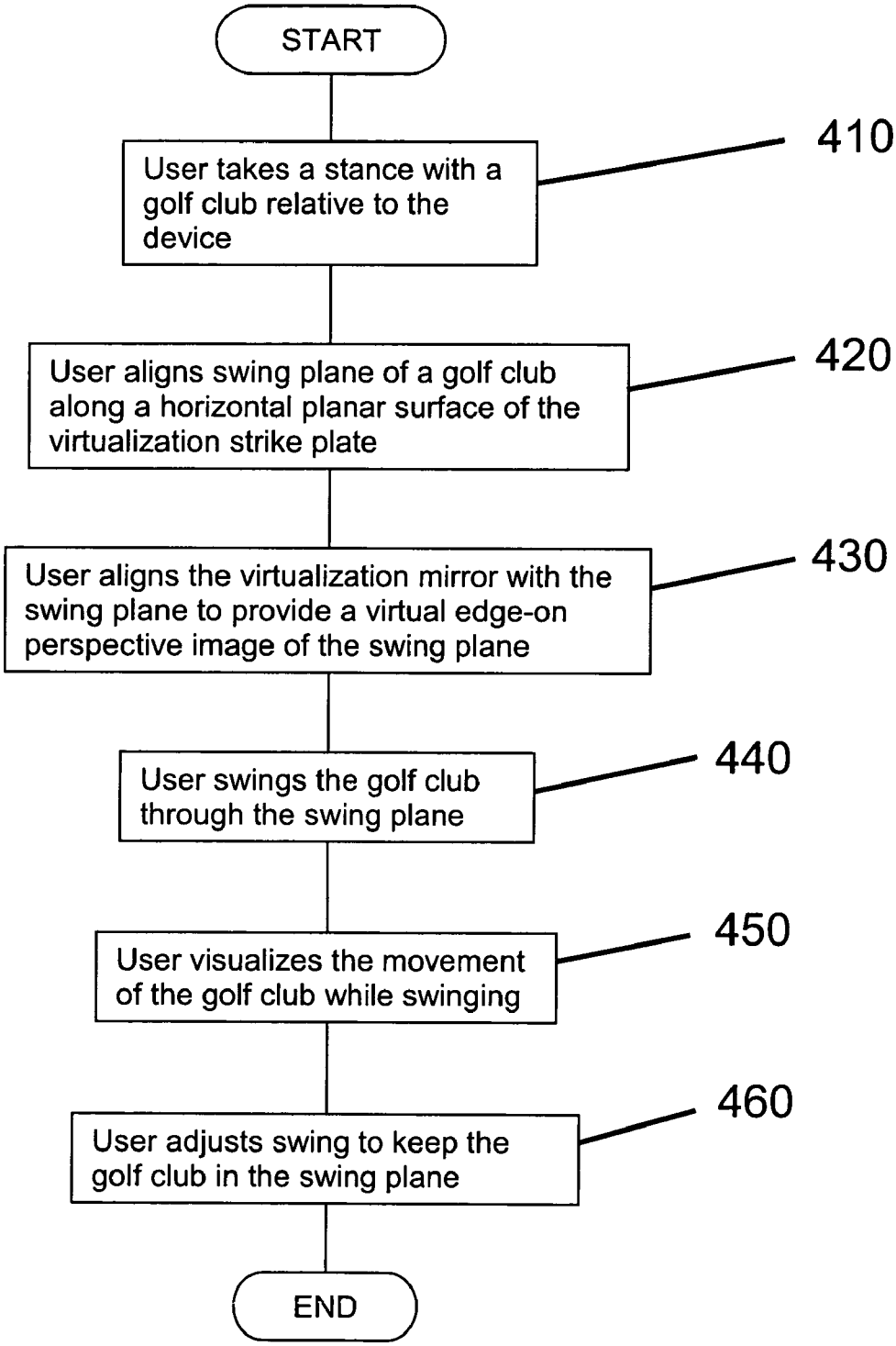
FIG. 4 is a flow chart illustration representing a method of using the golf swing training device.

A method of using the golf club swing trainer device 100 is provided by the current invention and shown in FIG. 4. The method includes a step 410 where a user takes a stance with a golf club relative to the device 100 whereby the user may visually interact with the device 100 during the swinging of the golf club. In a second step 420, the user aligns a swing plane of the golf club along a horizontal planar surface of a virtualization strike plate including a top reflective surface that directly interacts with a club head of the golf club and a user's line of sight during the swinging of the golf club. In a third step 430, the user aligns a virtualization mirror with the swing plane to provide a virtual edge-on perspective image of the swing plane to be visualized by the user in their line of sight. The virtual image 155 seen by the user is of the user and the golf club. The user is able to see and track, from the virtual image 155, their individual swing of the golf club. Critically, the user is able to monitor this virtual image without having to substantially adjust their line of sight. Thus, the user can keep their eye on the golf ball they are attempting to strike throughout the swing process while also visualizing their swing. In step 440, the user swings the golf club through the swing plane that is at least in part substantially along the horizontal planar surface of the strike plate, and in step 450, the user visualizes the movement of the golf club while swinging the club. This visualization of the user's swing allows the user to obtain real-time information regarding the motion of the golf club during the swinging of the golf club. Finally, at 460, the user adjusts their swing to keep the golf club in the swing plane throughout the swing.

The current invention further contemplates additional steps of this method, such as providing direction for the golf club swing via an alignment mechanism. It is further contemplated that the current invention allows a user to re-position the virtualization mirror along the strike plate and a distance from the strike plate. In addition, the current invention may provide a user information about the club head strike location and direction from an impact film upon the strike plate.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

The invention claims is:

1. A golf swing training device, comprising:

a first mirror and a second mirror, said first mirror comprising a virtualization strike plate establishing a substantially horizontal planar strike surface on a top surface thereof, including a reflective strike surface that interacts directly with a club head of a golf club and a user's line of sight to the club head of the golf club as the golf club progresses through a swing plane in relation to the strike surface, said strike surface having a golf ball mounting assembly thereon for supporting a golf ball on the strike surface and presenting the golf ball to the user for striking with the golf club; and said second mirror comprising a virtualization mirror operationally connected to the strike plate for presenting to the user a line of sight virtual image of the user through the reflective strike surface while the user is swinging the golf club, wherein the virtual image shows the swing plane of the golf club from a perspective that is substantially perpendicular to the swing plane and allows the user to directly obtain real-time information regarding the motion of the golf club through the swing plane during the swing.

2. The apparatus of claim 1 wherein the combination of the first mirror and second mirror presents the user with a virtual image of the user in an area that encompasses less than the area of the entire top surface of the strike plate.

3. The apparatus of claim 1 wherein the top surface of the strike plate includes an alignment mechanism.

4. The apparatus of claim 1 wherein the top surface of the strike plate includes a protective film.

5. The apparatus of claim 4 wherein the protective film includes an alignment mechanism.

6. The apparatus of claim 4 wherein the protective film is optically clear.

7. The apparatus of claim 1 wherein the virtualization strike plate includes a bottom surface connected with a support mechanism allowing deflection of the virtualization strike plate.

8. The apparatus of claim 7 wherein the support mechanism is selected from the group consisting of a foam padding, a single column support assembly, a multi-column support assembly, and a hydraulic support assembly.

9. The apparatus of claim 1, further comprising an adjustment mechanism for adjusting the virtualization mirror with regard to position and angle relative to the strike plate.

10. The apparatus of claim 1 wherein the virtualization mirror is at least one of curved along its long axis or spherically curved.

11. The apparatus of claim 1, further comprising a frame assembly.

12. The apparatus of claim 11 wherein the frame assembly positions the virtualization mirror a distance from the virtualization strike plate that allows for interaction with the swing plane of the user controlled golf club.

13. The apparatus of claim 11 wherein the frame assembly is collapsible.

14. The apparatus of claim 1, further comprising a positioning mechanism for adjusting the virtualization mirror in relation to the virtualization strike plate.

15. The apparatus of claim 1 wherein the virtualization strike plate comprises a shatter resistant mirror.

16. The apparatus of claim 1 wherein the virtualization mirror is shatter resistant.

17. A method of using a golf swing training device, comprising the steps of:

providing a virtualization strike plate establishing a substantially horizontal planar strike surface on a top surface thereof, including a reflective strike surface that interacts directly with a club head of a golf club and a user's line of sight to the club head of the golf club as the golf club progresses through a swing plane in relation to the strike surface, said strike surface having a golf ball mounting assembly thereon for supporting a golf ball on the strike surface and presenting the golf ball to the user for striking with the golf club;

providing a virtualization mirror operationally connected to the strike plate for presenting to the user a line of sight virtual image of the user through the reflective strike surface while the user is swinging the golf club;

aligning the swing plane of the golf club along the horizontal planar surface of the virtualization strike plate;

aligning the virtualization mirror with the swing plane to provide a virtual image to be visualized by the user in their line of sight, wherein the virtual image shows the swing plane of the golf club from a perspective that is substantially perpendicular to the swing plane;

swinging the golf club through the swing plane that is at least in part substantially along the horizontal planar surface of the strike plate; and visualizing the swing by the user who obtains real-time information regarding motion of the golf club through the swing plane and motion of the user's body relative to the swing plane during the swinging of the golf club.

18. The method of claim 17, further comprising the step of providing direction for the club swing via an alignment mechanism.

19. The method of claim 17, further comprising the step of allowing re-positioning of the virtualization mirror along the strike plate and a distance from the strike plate.

20. The method of claim 17, further comprising the step of providing information about strike location and direction from an impact film upon the strike plate.

* * * * *